United States Patent [19]

Davis

[11] 4,308,636

[45] Jan. 5, 1982

[54] METHOD AND APPARATUS FOR HEATING A FLUID

[76] Inventor: John W. Davis, 3717 Guadalupe Rd., Fort Worth, Tex. 76116

[21] Appl. No.: 945,450

[22] Filed: Sep. 25, 1978

Related U.S. Application Data

[63] Continuation-in-part of Ser. No. 809,296, Jun. 23, 1977, abandoned.

[51] Int. Cl.[3] ..... A47L 11/34

[52] U.S. Cl. ..... 15/321; 219/10.51

[58] Field of Search ..... 15/321; 219/10.51, 300

[56] References Cited

U.S. PATENT DOCUMENTS

| | | | |
|---|---|---|---|
| 1,402,021 | 1/1922 | Snelling | 219/300 |
| 1,402,873 | 1/1922 | Ledwinka | 219/300 |
| 1,563,296 | 11/1979 | Scarborough | 219/10.51 |
| 2,616,022 | 10/1952 | Arnaud | 219/300 X |
| 3,133,182 | 5/1964 | Landmann | 219/300 |
| 3,215,416 | 11/1965 | Liben | 219/300 X |
| 3,439,374 | 4/1969 | Wisdom | 15/321 |
| 3,518,470 | 6/1970 | Dillarstone | 219/300 |

FOREIGN PATENT DOCUMENTS

| | | | |
|---|---|---|---|
| 1430989 | 4/1976 | United Kingdom | 15/320 |

*Primary Examiner*—Christopher K. Moore
*Attorney, Agent, or Firm*—Wofford, Fails & Zobal

[57] ABSTRACT

Method and apparatus for heating a fluid, such as water, for any of several purposes, such as for use with carpet cleaning apparatus; and charcterized by supplying electrical current periodically to the primary of a conductive coil, thereby building and collapsing a field about a shorted electrically conductive secondary of the coil. The shorted secondary is a hollow conductor that is heated by high current flow. The heat is transferred to a fluid flowing through the hot, shorted secondary. In a specific aspect of the embodiment, a frame including spray nozzles, vacuum nozzles and the like has the apparatus for heating water connected into it such that heated water is supplied, to effect much more efficacious cleaning of carpets or similar floor surfaces. Also disclosed are specific details and preferred embodiments that have been constructed to date; particularly, the details of the apparatus in which the primary and the secondary coils are closely adjacent each other such that the $I^2R$ heating that occurs in both the primary and secondary due to the building and collapsing of the field contribute to heating of the fluid passed through the fluid passageway in the secondary with the primary and secondary overwound on the same leg of the core, more of the flux that builds and collapses passes through both the primary and secondary so there is more heating of the fluid passing through the secondary. The hollow conductor of the secondary is deliberately shorted with a continuous weld so that there are an infinite number of elemental shorting bars whose $I^2R$ losses produce greater heating of the fluid passed through the secondary.

9 Claims, 6 Drawing Figures

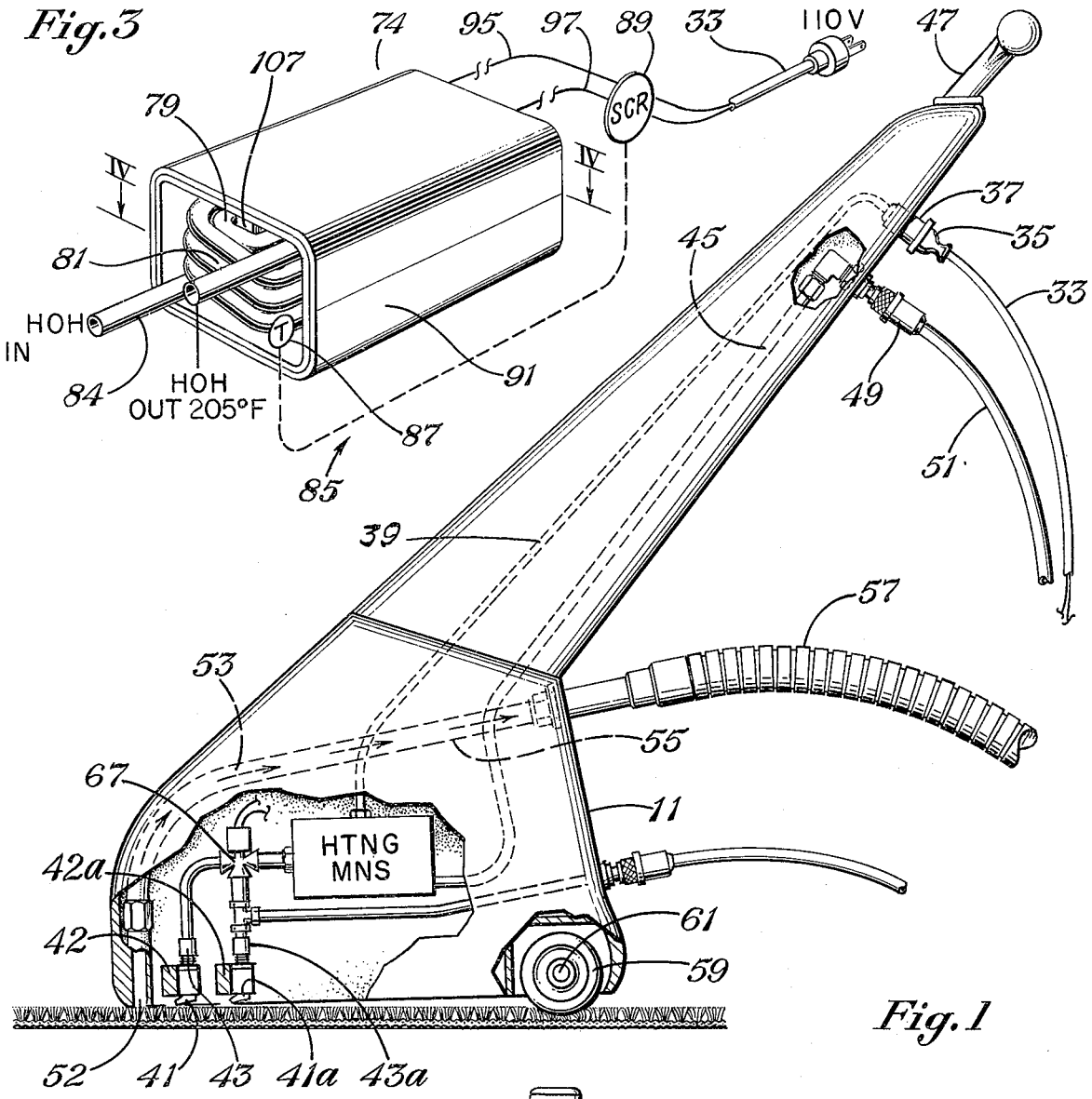
Fig.3
74
95
97
89
33
110V
47
107
79
SCR
IV
IV
81
HOH
IN
84
HOH
OUT 205°F
91
87
85
45
37
35
33
49
51
39
57
53
55
67
11
HTNG
MNS
42a
42
61
59
52
41
43
41a
43a
Fig.1
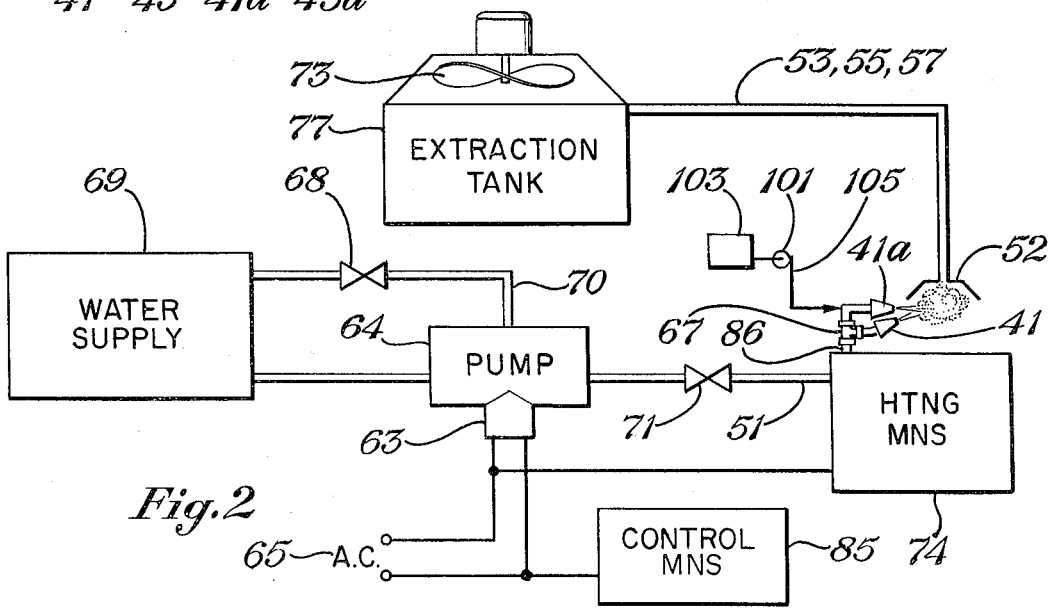
73
53,55,57
77
EXTRACTION
TANK
69
68
103
101
105
41a
52
WATER
SUPPLY
70
64
PUMP
67
86
41
71
51
HTNG
MNS
63
Fig.2
65
A.C.
CONTROL
MNS
85
74

METHOD AND APPARATUS FOR HEATING A FLUID

CROSS REFERENCE TO RELATED APPLICATIONS

This application is a continuation-in-part application of my earlier filed application Ser. No. 809,296, filed June 23, 1977, and now abandoned, entitled "METHOD AND APPARATUS FOR HEATING FLUID."

BACKGROUND OF THE INVENTION

1. Field of the Invention

This invention relates to floor cleaning apparatus employing hot water sprayed against the floor surface to be cleaned, the water thereafter being retracted with a suction nozzle and brush arrangement to an extraction tank. In broad aspects, this invention relates to method and apparatus for heating a fluid.

2. Description of the Prior Art

The prior art has seen a wide variety of methods and apparatus for heating a fluid. It is also known in the prior art to use nozzles for discharging hot water against the surface of a carpet or the like to increase the efficacy of cleaning dirt and foreign material from the floor surface. Ordinarily, hot water in such embodiment is generated in a heating tank that includes an electrical heating element and is fed to the nozzles by pump. The extraction tank used in the prior art has a fan or other vacuum generating means in its upper surface and is connected to the vacuum nozzle on the floor unit by a flexible hose in the prior art. Such devices have a number of significant disadvantages including the difficulty in withdrawing sufficient amounts of moisture from the carpet to prevent a prolonged period of wetness and shrinkage. Also, complete dirt and soil extraction was not always effected because the water temperature was only in the range of about 130° F. Typical of the closest prior art of which I am aware are the following U.S. Pat. Nos. 1,402,021; 1,402,873; 2,616,022; 3,133,182; 3,215,416; 3,439,374; 3,518,410 and 3,699,607; as well as British Pat. No. 1,430,989. For discussing the differences between those and the Applicant's invention, the references can be grouped. The references U.S. Pat. Nos. 3,133,182; 1,402,021; 1,402,873 and the British Pat. No. 1,430,989 all provide inadequate heating and in the cases where they use shorted secondaries, use two legged cores that lose efficiency of heating as in a three legged core. This loss of efficiency is due to the physical placement of the secondary on the core and the technique by which the secondary is shorted. In fact, the British Pat. No. 1,430,989 relies upon resistance type heating which is much too slow in the applications of this invention. In U.S. Pat. No. 3,215,416, the secondary coil is disposed about an iron core but is spaced longitudinally of the iron core from the primary coil, such that it is relatively inefficient and could not be employed advantageously in the applications of this invention. Similarly, U.S. Pat. No. 2,616,022 employs a shorted secondary in which the secondary coil is wrapped around an iron core remote from the primary coil and thus does not take advantage of the $I^2R$ heating in the primary. The shorting bar of the secondary is remote from the coil and is exposed to the air for deliberate cooling and consequently suffers heat losses to the atmosphere. U.S. Pat. No. 3,518,410 is pertinent in employing a three legged core and the specific coil geometry but the secondary is shorted by a remote bar (similar to U.S. Pat. No. 2,616,022) and thus does not take advantage of having the shorted secondary completely within the collapsing field and contiguous the primary so as to take advantage of the $I^2R$ loss type heating in both coils. Also, U.S. Pat. No. 3,518,410 has a higher resistance, thus limiting the current flowing in the secondary, as contrasted with a shorted secondary. Consequently, its apparatus does not produce as much $I^2R$ heating and, therefore, is less efficient. U.S. Pat. No. 3,699,607 employs a cylindrical brush in conjunction with a water vacuum but does not provide a totally satisfactory solution since the water was heated so slowly that it was not hot enough to be effective as needed. Particularly, the prior art has not supplied fluid heating apparatus or floor cleaning apparatus that operated so fast that it obviated the necessity for pre-heating the fluid such as water.

SUMMARY OF THE INVENTION

Accordingly, it is an object of this invention to provide method and apparatus that obviates the disadvantages of the prior art, and enables rapidly heating a fluid to a temperature so as to be effective, as for cleaning a floor surface or the like.

It is a specific object of this invention to provide a small heating means that can be incorporated into a floor cleaning apparatus that can be moved readily about a floor surface, yet rapidly heat water that is employed to effectively clean the floor surface; the heating being so rapid that no pre-heating is necessary.

These and other objects will become more fully apparent from the following descriptive matter, particularly when taken in conjunction with the appended drawings.

In accordance with this invention, there is provided apparatus for cleaning floor surfaces, especially carpets or the like characterized by a frame having a handle extending upwardly and rearwardly, a plurality of fluid nozzles for spraying hot water near the floor surface, heating means for heating the water flowed to the floor surface, vacuum nozzle carried by the frame and positioned adjacent the contact of the water with the floor surface for extracting the heated fluid, dirt and the like from the floor surface, conduit means for supplying the heated fluid and means for supplying the fluid under pressure to the conduit. The heating means comprises a primary coil having means for connecting with a source of a current capable of effecting building and collapsing of an electromagnetic field in the primary coil and in a shorted secondary coil having an electrical conductor adapted for conducting high current; and conduit means for flowing the fluid through the electrical conductor for transfering heat from the electrical conductor to the fluid for heating the fluid rapidly so as to effect the desired high temperature.

To another embodiment of this invention, there is provided apparatus for heating a fluid that is characterized by the same primary coil connectable with a source of current effecting building and collapsing of an electromagnetic field and the shorted secondary coil having the electrical conductor for conducting high current and means for flowing the fluid to be heated through the electrical conductor for transfering heat from the electrical conductor to the fluid for heating the fluid rapidly.

In still another embodiment of this invention there is provided a method of heating a fluid comprising the steps of: (a) supplying to an electrically conductive primary coil and electrical current the effects building and collapsing of an electromagnetic field; (b) emplacing an electrically conductive secondary coil within the electromagnetic field and short circuiting the secondary coil to effect a high current flow and generate heat rapidly; and (c) flowing a fluid in heat exchange relationship with the shorted secondary so as to effect transfer of heat from the shorted secondary to the fluid.

Preferably, in the respective embodiments there is employed a control means for controlling the current flow to the primary of the coil as as to control the temperature in the secondary and in the fluid; and employing a heating means in which the primary and secondary are closely adjacent each other so that the $I^2R$ heating in both primary and secondary contribute to the heating of the fluid passing through the secondary; where, because of the geometry of the two coils, more flux passes through both the primary and the secondary coils for obtaining greater heating; and in a particularly preferred embodiment in which the secondary coil is deliberately shorted with a continuous weld so as to form an infinite number of small elemental shorting bars whose $I^2R$ heating contributes to heating the fluid.

BRIEF DESCRIPTION OF THE DRAWINGS

FIG. 1 is a side elevational view, partly in section, illustrating a carpet cleaning apparatus constructed in accordance with the principles of this invention.

FIG. 2 is a schematic diagram of a fluid and electrical system in accordance with the embodiment of FIG. 1.

FIG. 3 is an isometric view of the heating means of the embodiment of FIG. 2.

DESCRIPTION OF THE PREFERRED EMBODIMENTS

Figure 4:
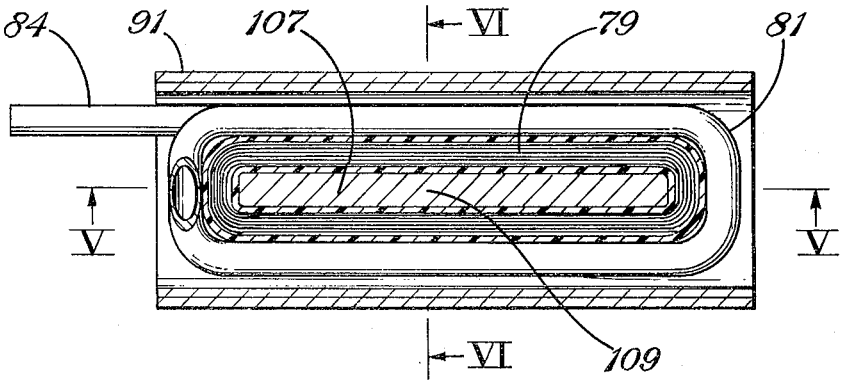
FIG. 4 is a cross-sectional view from the top of the heating means of FIG. 3 along the plane IV—IV.

It is to be borne in mind that the method and apparatus of this invention have a wide variety of uses for heating a variety of fluids for any of several purposes. The primary embodiment with which the invention will be described hereinafter is, however, in the use of apparatus for cleaning a floor surface, such as carpet or the like.

Referring to FIG. 1, the numeral 11 designates a frame. The frame may be constructed of metal or laminated fiberglass and epoxy or high impact resistant plastic to form the exterior or a portion of the carpet cleaning apparatus referred to as a cleaning head.

A connectable electric circuit; including an electrical cable 33, removable plug 35, socket 37, and interior conductor cable 39; is carried by the frame 11 to supply electrical energy. The cable 33 has a plug-in socket for plugging into conventional alternating current source.

A plurality of fluid nozzles 41, 41*a*, are carried by the frame 11. The nozzles are arranged in parallel rows that are horizontal and supplied by fluid from hollow conduits 43, 43*a* that are in fluid communication with the conduit 45. The conduit 45 extends upwardly through the handle 47 briefly and rearwardly from the apparatus. A quick disconnect coupling 49 connects a flexible hose 51 with the conduit 45 for introducing water to the apparatus and ultimately to the nozzles either 41 or 41*a*. The outlets of the nozzles 41, 41*a* are carried by respective bars 42, 42*a* and are arranged to discharge hot water, either as a cleaning solution or as rinsing water, adjacent the engagement of vacuum nozzle 52 with the floor surface. The nozzles 41, 41*a* face toward the vacuum nozzle 52 so that the heated water can be sucked through and wash or rinse the fibers of a carpet without wetting the backing. Preferably, the angles of the nozzles are about 45° so as to discharge for optimum pickup of the hot fluid and the dirt from the floor covering.

A vacuum nozzle 52 is formed interiorly of the frame 11 in a narrow passageway extending across the width of the apparatus but tapering gradually along an interior region 53 to a circular cross-sectional configuration 55 for connection with a flexible vacuum hose 57. Thus, the vacuum nozzle is adjacent the floor surface opposite the fluid nozzles 41, 41*a* and retracts moisture and foreign materials from the floor surface, or carpet, as the apparatus is drawn backward by the handle 47.

For the purpose of increasing the quantity and effectiveness of the vacuum generated through the nozzle 53, the frame 11 comprises an exterior shell extending downwardly to define an exterior periphery at substantially floor level to cover the vacuum nozzle 52, and the fluid nozzles 41, 41*a*. The suction generator is contained in a console (not shown) and produces a vacuum in the range of 6–9 inches of mercury and the shell configuration enables obtaining an additional 2 inches of mercury vacuum using the same vacuum fan.

A roller 59 is supported on a horizontal shaft 61 connected with the frame 11. The roller 59 may be constructed of any material and is preferably plastic such as polyurethane. The roller 59 supports a portion of the weight of the apparatus. It preferably has adjustment levers (not shown) for positioning at various vertical heights.

As shown in FIG. 2, the nozzles 41, 41*a* receive water from an optional pump 64 having a control 63. If appropriate, the line water pressure may be employed without a pump. Energy is supplied from an electrical energy source 65. A valve 68 is disposed in a conduit 70 to circulate water back to a supply 69 in the event there is too high a pressure. This recirculation portion of the fluid circuit can be omitted if desired. The pump is connected at its discharge with valve 71 and a flexible hose 51 to supply water to the heating means (HTNG MNS) 74. As illustrated in FIG. 1, the heating means 74 is preferably carried by the frame 11 closely adjacent the nozzles 41 and 41*a* to minimize heat losses and insure that hot water is washed through the fibers of the carpet.

As described in my priorly filed co-pending application, Ser. No. 809,296, it was deemed necessary in the prior art to heat the water to about 130° in a water supply tank in the console in order to have adequate heat in the water. Because of the surprising efficacy of the heating means of this invention, however, this hazardous pumping of the hot water has been found unneccessary, obviating the danger of scalding of operators and the like.

A solenoid operated valve 67 is provided in the hot water conduit 86 from the heating means 74 for passing the hot water to the nozzles 41*a* on the cleaning cycle or to nozzles 41 on the rinse cycle. The control switch (not shown) is operated to either wash or rinse in accordance with conventional technology and need not be detailed herein. When switched to the wash cycle, a pump 101 is energized to pump cleaning chemicals from a reservoir 103 via conduit 105 to be admixed with the hot water in the conduit to nozzles 41*a*. A cleaning solution may be any of the commercial cleaning solutions available on the market and usually incorporates a surfactant such as the non-ironic surfactants like nonyl phenol with 10–100 mols of ethylene oxide associated with each molecule of nonyl phenol. Of course, other surfactants may be chosen, as may other agents to prevent fading of dyes or other deleterious effects. This technology is well known and has been delineated in many patents so need not be repeated herein.

When the valve 71 is opened, hot water is discharged by way of the heating means 74 and the nozzles 41*a* during the cleaning cycle onto the carpet adjacent the vacuum nozzle 52. The hot water incorporates the cleaning solution from the reservoir 103. The cleaning solution is urged through the fibers of the carpet toward the vacuum nozzle 52 to wash the fibers without wetting the backing and causing shrinking or the like. From the vacuum nozzle 52, the water and dirt are sent to the extraction tank 77, as on the separate cart, or console.

In the prior art apparatus, the temperature of the water was not hot enough to obtain satisfactory cleaning. Consequently, the heart of this invention lies in the heating means 74.

Referring to FIGS. 3–6, the heating means 74 includes a primary coil 79 and a secondary coil 81.

Figure 5:
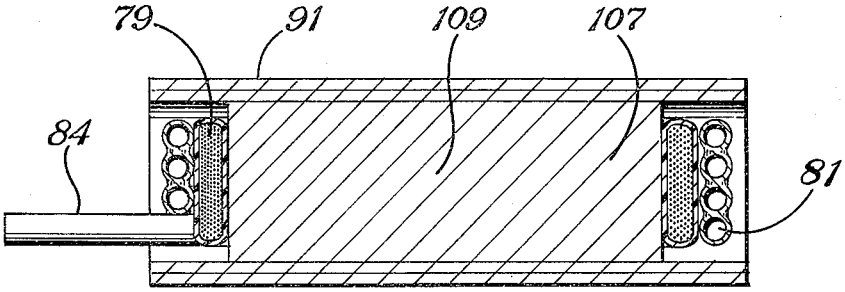
FIG. 5 is a cross-sectional taken along the lines V—V of FIG. 4.
Figure 6:
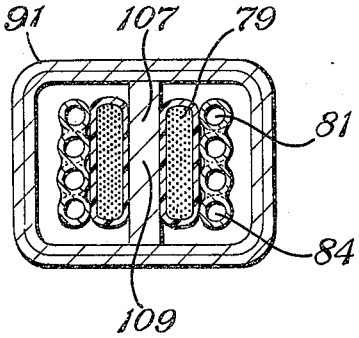
FIG. 6 is a cross-sectional view taken along the lines VI—VI of FIG. 4.

The primary coil 79 has a means such as electrical cord 33 for connecting with a source of electrical energy capable of effecting building and the collapsing of an electromagnetic field about the primary coil. For practical purposes this will be alternating current power source, such as 110 volt AC outlet in a home. As is understood, the primary coil comprises an electrical conductor that will be wound, as about or within a core, with many turns. Preferably, an armature, or soft iron central core, 107, FIGS. 4–6, is employed for more effective development of the collapsing and building of the electromagnetic field. As illustrated, a metallic shell 91 comprises a laminated metallic structure. The number of turns that are employed in the primary coil will depend upon the magnitude of the heating to be done. It has been found satisfactory to employ from 50–1,000 turns in the primary. The optimum for use in the apparatus for cleaning a floor surface, as described herein, appears to be about 100–150 turns. The number of taps may be varied to optimize construction and keep the size as small as possible for the present application. Only two taps 95 and 97 have been illustrated herein. The number of turns in the structure must be adequate to insure an electromagnetic field that will encompass the secondary coil 81.

The secondary coil 81 has an electrical conductor adapted for conducting high current and has a fluid passageway defined therewithin for a flowing fluid to be heated. The electrical conductor transfers heat rapidly from the electrical conductor to the fluid flowing through it. In effect, the electrical conductor is in the form of one or more electrically conductive sheaths disposed on each side of the fluid passageway. As illustrated, the secondary coil comprises a plurality of turns of metallic tubing 84 that are connected together laterally so as to form the desired number of turns in the secondary coil, that number being less than the number of turns in the primary coil. The metallic tubing may be any of the electrically conductive tubing, such as aluminum tubing, stainless steel tubing, copper tubing, and the like. In the illustrated embodiment, copper tubing is employed for its excellent electrical and heat conductivity and resistance to corrosion by the water being flowed interiorly thereof. As illustrated, three turns of the copper tubing are silver soldered together laterally so as to act as a single turn shorted secondary coil for exceptionally high electrical current flow. The shorted secondary coil has, however, serial fluid flow characteristics which increases the fluid transit time through the coil so as to enable substantially immediate and greater heating of the water to an outlet temperature in the range of 200°–205° F. in a single pass-through. The tubing should be large enough to handle at least $\frac{3}{4}$ gallon per minute (3.3 liters per minute). Of course, larger or smaller sized tubing can be employed, or greater pressure drops employed, to obtain higher rates of flow. With some apparatus, as little as one quart per minute (1.1 liter per minute) can be employed satisfactorily.

Thus, it can be seen that with the illustrated embodiment, when connected electrically, the primary can draw about 20 amperes (amps) per minute flow and produce about 2,000 amps current flow in the secondary that has been shorted in a special way. As will be immediately apparent, this produces tremendous heat and requires the flow of fluid such as water to prevent damage. Because of the step down in voltage, however, the secondary will have a very low induced voltage, or differential electromotive force, so there is no electrical shock hazard to operating personnel.

Because of the high heat, it is preferred to employ a control means 85, as illustrated in FIGS. 2 and 3. The control means 85 includes a thermistor 87 that is connected in control of a silicon controlled rectifier (SCR) 89 to control the outlet temperature. For example, the thermistor 87 may be disposed in heat communication with the effluent water and control the temperature in the range of 200°–205° F. As is recognized, this is done by rendering the silicon controlled rectifier conductive for as long as it takes to build up the heat and thereafter rendering it non-conductive. If desired, of course, the control means 85 may employ means for gradually reducing or increasing the current. Such circuits are, however, more elaborate than necessary in the simple embodiment illustrated. Such control means are well known and run the gambit from controllers that alter resistance in a circuit to alter the current to integrated circuit components employing field effect transistors with biasing controllers.

The construction of the heating means, and particularly of the primary and secondary coils, is critical to the performance of this invention. The primary and secondary coils are disposed closely adjacent each other such that the heating due to the $I^2R$ effect, normally termed loss, in the transformer effect contributes to the heating of the fluid being flowed through the secondary passageway, or conduit. Moreover, all of the lines of force should build and collapse about both the primary and secondary coils. As indicated hereinbefore, the shorted secondary is shorted within the coil itself, rather than exteriorly thereof, so there is utmost efficiency in using the heat to heat the fluid flowing therethrough. The more nearly completely the lineal length of the secondary coil is soldered together, the better is the heating effect. The smaller the amount of silver solder that is employed, however, the better the heating that is realized.

In the preferred embodiment of this invention, multiple windings of the secondary coil 81 are silver soldered together throughout their entire length such that all such secondary shorting is accomplished fully within the most concentrated portion of the building and collapsing electromagnetic field to assure the maximum number of lines of force are involved while achieving the minimum resistance possible to current flow. Additionally, the secondary is wound on the same core as is the primary and both are symmetrical about a common point 109.

Inasmuch as the unit intensity of the electromagnetic field decreases by the square of the distance from the electromagnetic center of the primary and inasmuch as the current induced in the secondary coil 84 is directly proportional to the number of lines of force cut by the secondary coil, the secondary coil should be positioned as closely adjacent the primary coil as is allowed by the physical extremities of the primary winding and insulation thereof to maximize the current within the secondary coil and thus the $I^2R$ heating. Any shorted portion of the secondary coil which is outside of the field of maximum intensity contributes little to the $I^2R$ heating process.

Such aforementioned physical proximity likewise insures a maximum transfer of the smaller primary coil 79 $I^2R$ heat energy and the heat energy radiated from the iron core 107 due to magnetic hysteresis loss endemic in core iron undergoing continuous reversals of the magnetic field by conduction and convection to the secondary coil 81.

While the reasons for the efficacy is not completely understood, it is theorized that the continuous welding, or silver soldering, together of the coils of the secondary lowers the resistance of the secondary coil and allows higher current flow and acts as an infinite number of small conductors whose $I^2R$ effects contribute significantly to the heating of the fluid flowing through the coils 84. It is imperative that the secondary coil be shorted within the coils to realize the full effects of the surprising effective heating.

In the illustrated embodiment, the primary coil and the shorted secondary coil are symmetrical about a common point 109, FIGS. 4–6. The symmetry is true in the radial directions, as by sweeping in a 360° arc about the point 109 in FIG. 4; as well as in the axial directions, as by sweeping to both the right and left in FIG. 5. The term "symmetrical" is used in the engineering sense of being substantially symmetrical, since obviously the in and out conduits from the secondary, as well as the taps and wires to the primary, do not contribute in a significant way and need not by symmetrical.

The construction of this invention is particularly advantageous, since it has all of the following features: (1) it takes advantage of the hysteresis losses in the transformer core to effect heating of the fluid being flowed through the coil in the secondary. Expressed otherwise, more energy goes into producing the magnetization than is returned when the magnetization decreases and the lost energy is converted to heat which is transferred to both the primary and secondary coils of this invention; (2) the heat in the form of the normal $I^2R$ losses are employed in this invention in generating heat in both the primary and secondary coils; (3) essentially all of the lines of force are contained within the core and this invention uses substantially 100% of the magnetic induction field coupled to the secondary, since the secondary is wound on the same core as is the primary and it juxtaposed therearound; (4) this construction employs the highest possible efficiency by shorting the coils interiorly of the volume build-up of the magnetic field as opposed to shorting the ends of the coils outside of this area that loses the $I^2R$ losses generated in the shorting shunts outside of the field and outside of the secondary coil. Moreover, the shorting of the coil interiorly of the coil, itself, and of the field, reduces the electrical resistance of the coil and approaches the theorically optimum resistance to achieve more current flow and increased heating.

In any event, the heating means 74 is capable of raising the temperature to just below its boiling point in a single pass for achieving the superior cleaning with a small heating means 74. The heating means 74 should not produce steam since inferior cleaning results are obtained if steam is produced.

From the foregoing, it can be seen that the apparatus is connected as described and pulled across the carpet. The hot water is sprayed in front of the vacuum nozzle while the dirty water, dirt and other undesired materials are vacuumed from the floor covering.

Best results are obtained by pulling the apparatus rearwardly such that the sequence of operation is first the laying down of a stream of hot water, vacuuming hot water and dirt through the carpet fibers and retracting with the vacuum the hot water and dirt from the floor surface. Of course, the respective hot water supply and extraction tanks are emptied or filled as desired for most efficient operation. The following examples illustrate embodiments of the invention that have been found to be satisfactory.

EXAMPLE I

In this example, the heating means was introduced into the illustrated apparatus for cleaning a floor. The primary had 110 turns with a 110 volt source. The primary drew 20 amps current. The single turn, continuously shorted secondary, comprising three turns of copper tubing, had about 2,000 amps flowing in it to heat the water. The water entered at 130° F. and exited, at a flow rate of ¾ gallon per minute, at a temperature in the range of 200°–205° F. A thermistor was employed in conjunction with an SCR as a control means for controlling the current in the primary to cycle the temperature and heating within the indicated range. Satisfactory results were obtained in that superior cleaning was effected over use of only 130° water as had been done before this invention.

EXAMPLE II

In this example, the transformer employed in the heating means had 147 turns in the primary and was connected with a 220 volt source. The same single turn shorted secondary was employed. It carried exceptionally high current that was difficult to measure. Satisfactory cleaning was employed.

It should be noted that the transformers can be varied to compensate for cable lengths of up to 200 feet for industrial cleaning.

While this invention has been described hereinbefore with respect to apparatus for cleaning a floor covering, it is immediately apparent to one skilled in the art that it is widely useful in providing a means for heating a fluid in which the shorted secondary provides immediate and highly effective heating such that the fluid can be flowed adjacent thereto and carry the heat away, while being heated. This portends usefulness in a wide variety of applications from heating homes and swimming pools to heating air or carbon dioxide circulated in contact with bread or the like for effecting rising of the dough. The device is particularly satisfactory and adapted to heating liquids that can be circulated through metallic tubing employed as the shorted secondary.

From the foregoing, it can be seen that this invention achieves the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and scope of this invention.

What is claimed is:

1. Apparatus for cleaning floor surfaces, especially carpet, comprising:

a. a frame having a handle extending upwardly therefrom for facilitating movement of said frame about said floor surface;

b. a plurality of fluid nozzles carried by said frame in at least one row parallel to said floor surface and operational to spray fluid toward the floor surface;

c. heating means connected with and upstream of said fluid nozzles for heating the fluid flowed therethrough; said heating means being located within said frame and close to said fluid nozzles so as to have minimal heat loss; said heating means consisting essentially of primary and secondary coils disposed in annular concentric relationship with respect to each other and adjacent and in concentric relationship with respect to a core;

i. said primary coil having many more turns than said secondary coil such that said electromagnetic field efficiently builds and collapses through both said primary and secondary coils and introduces a much higher current flow in said secondary coil than in said primary coil; said primary coil having means for connecting with a source of current capable of effecting building and collaspsing of an electromagnetic field in said primary coil, and in said closely disposed secondary coil, and ii. said shorted secondary coil comprising an electrical conductor in the form of an electrically conductive sheath adapted for conducting high current and having at least one fluid passageway defined therewithin for flowing said fluid adjacent said electrical conductor for transferring heat from said electrical conductor to said fluid for heating said fluid rapidly; said shorted secondary coil being shorted continuously within the length and breadth dimensions of said coil and said electromagnetic field so as to have lower resistance and higher current flows, and on infinite number of $I^2R$ heat generators resulting in its higher heating and greater efficiency than if shorted exteriorly of said secondary coil; said primary coil and said shorted secondary coil being closely disposed adjacent each other such that substantially all of the flux of said electromagnetic field builds and collapses through both said primary and said secondary coils with resultant great efficiency in inducing electrical current to flow in and heat said shorted secondary coil and the fluid flowing therethrough, such that the $I^2R$ heating occurs in both primary and secondary coils and contributes to heating the fluid flowing through said passageway in said shorted secondary coil;

d. a vacuum nozzle carried by said frame and positioned adjacent the floor surface opposite said fluid nozzles for extracting the heated fluid, dirt and the like from said floor surface;

e. conduit means in fluid communication with said fluid nozzles and heating means for supplying pressurized fluid thereto; and f. means for supplying fluid under pressure to said conduit means.

2. The apparatus of claim 1 wherein an automatic control means is provided for automatically controlling the flow of electrical current to said primary coil so as to control the temperature in the shorted secondary and the fluid flowing therethrough.

3. The apparatus of claim 1 wherein said primary coil has means for connection with an alternating current power source wherein said fluid passage makes a plurality of traverses through said shorted secondary for efficient transfer of heat to said fluid to achieve the desired hot fluid at the fluid nozzles without melting said secondary coil.

4. The apparatus of claim 1 wherein said shorted secondary coil comprises a coil of metallic tubing that is electrically conductive, connected together laterally so as to effect fewer turns of conductor than said primary coil, and to effect shorting of said secondary within the dimensions of said secondary coil and arranged for conducting water therethrough; said coil of metallic tubing and said primary coil being concentric.

5. The apparatus of claim 1 wherein said primary and said secondary coils are symmetrical about a common point in both axial and radial directions; two rows of nozzles are employed, a first row being for washing; means are provided for adding a cleaning solution to the hot water being sprayed out said first row of coils for washing the fibers of said carpet; a second row being for rinsing; means for switching said hot water to the rinse cycle and eliminating the cleaning solution from the hot rinse water.

6. Apparatus for heating fluid comprising:

a. a primary coil having means for connection with a source of current capable of effecting building and collapsing of an electromagnetic field in said primary coil; and b. a shorted secondary coil comprising an electrical conductor in the form of an electrically conductive sheath adapted for conducting high current ahd having at least one fluid passageway defined therewithin for flowing the fluid adjacent said electrical conductor for transferring heat from said electrical conductor to said fluid for heating said fluid rapidly; said shorted secondary coil being shorted continuously within the dimensions of said coil so as to have lower resistance and higher current flow and, hence, higher heating and greater efficiency than if shorted exteriorly of said secondary coil;

said primary coil and said shorted secondary coil being disposed closely adjacent and contiguous each other, without intervening impedance increasing chambers in between, and in annular concentric relationship with respect to each other, adjacent and in concentric relationship with a core for concentrating an electromagnetic field such that substantially all of the flux of said electromagnetic field builds and collapses about both with resultant great efficiency in inducing electrical current to flow in and heat said shorted secondary coil, such that the increased $I^2R$ heating occurs in both primary and secondary coils and contributes to heating the fluid flowed in said passageway in said shorted secondary coil; said primary coil having many more turns than said secondary coil such that said electromagnetic field efficiently builds and collapses through both said primary and secondary coil and introduces a much higher current flow in said secondary secondary coil than in said primary coil; said primary coil and said shorted secondary coil being symmetrical about a common point in both axial and radial directions.

7. The apparatus of claim 6 wherein there is provided an automatic control for automatically controlling the current to said primary coil for controlling the temperature in said shorted secondary coil and said fluid flowing therethrough; wherein said primary coil has means for connecting with an alternating current power source and wherein said fluid passageway makes a plurality of traverses through said shorted secondary for efficient transfer of heat to said fluid to achieve the desired hot fluid at the effluent of said shorted secondary coil.

8. The apparatus of claim 6 wherein said shorted secondary coil comprises a coil of metallic tubing that is electrically conductive, connected together laterally by an electrically conductive bond comprising a small amount of silver solder throughout the traverse of the turns of said secondary coil for decreased resistance and increased current flow without wasting heat heating a large mass of metal, as well as increased number of elemental shorting shunts intermediate the respective coils for increased heating and so as to effect fewer turns than said primary coil and to effect the shorting within the dimensions of the secondary coil and the electromagnetic field, and arranged for conducting said fluid therethrough.

9. A method of heating fluid comprising the steps of:

a. arranging a primary coil and a secondary coil closely adjacent and contiguous each other, without intervening impedance increasing chamber inbetween, and in annular concentric relationship with respect to each other, closely adjacent and about a soft iron core such that an electromagnetic field will build and collapse about both said primary and secondary coils with great efficiency in inducing electrical current to flow in and heat said secondary coil; forming said secondary coil in the form of a continuous electrically conductive sheath adapted for conducting high current and having at least one fluid passageway defined therewithin for flowing of fluid adjacent the electrically conductive sheath for transferring heat rapidly from said sheath to said fluid; forming said sheath by silver soldering respective coils of tubing together laterally with only a small mass of silver solder so as to form a low resistance completed electrical circuit within the shorted secondary coil such that said secondary coil is effectively electrically shorted continuously interiorly of its dimensions for achieving high current flow therein; forming said secondary coil closely adjacent said primary coil such that the $I^2R$ heating that takes place in both said primary and secondary coils contribute to heating of fluid flowing through said secondary coil;

b. supplying to said electrically conductive primary coil an electrical current that effects building and collapsing of an electromagnetic field; and c. simutaneously flowing said fluid to be heated through said fluid passageway in said conductive sheath of said secondary coil so as to flow in heat exchange relationship with the shorted secondary and effect transfer of heat from the shorted secondary to said fluid.

* * * * *